United States Patent [19]

Kobayashi

[11] 4,036,194

[45] July 19, 1977

[54] FUEL INJECTION SYSTEM

[75] Inventor: Hisanori Kobayashi, Aichi, Japan

[73] Assignee: Nippondenso Co., Ltd., Kariya, Japan

[21] Appl. No.: 594,089

[22] Filed: July 8, 1975

[30] Foreign Application Priority Data

| | | |
|---|---|---|
| July 14, 1974 | Japan | 49-80571 |
| Oct. 3, 1974 | Japan | 49-114186 |
| Oct. 23, 1974 | Japan | 49-122162 |

[51] Int. Cl.[2] ..... F02M 69/00

[52] U.S. Cl. ..... 123/139 AW; 137/118; 261/50 A

[58] Field of Search .... 123/119 R, 139 AW, 139 BG; 137/118; 261/50 A

[56] References Cited

U.S. PATENT DOCUMENTS

| | | | |
|---|---|---|---|
| 2,676,603 | 4/1954 | Kollsman | 123/119 R X |
| 3,431,900 | 3/1969 | Jackson | 123/119 R X |
| 3,896,778 | 7/1975 | Zeyns et al. | 123/139 AW |
| 3,946,714 | 3/1976 | Eckert et al. | 123/32 AE X |

*Primary Examiner*—Ronald H. Lazarus
*Assistant Examiner*—Tony M. Argenbright
*Attorney, Agent, or Firm*—Cushman, Darby & Cushman

[57] ABSTRACT

A fuel distribution system for an internal combustion engine with a plurality of fuel injection nozzles of the type including means for metering the total quantity of the fuel to be introduced into the engine, and means for dividing the fuel from said metering means into a plurality of fuel flows equal in number to the plurality of fuel injection nozzles and equal in quantity to each other, wherein the fuel dividing means comprises a housing, first and second diaphragms so arranged as to divide the housing into three chambers, restrictor means through which the fuel from the fuel metering means flows into each of the outer chambers of the three chambers, discharge means for each of the outer chambers, the discharge means having a valve port located in opposed relation with the diaphragm, and spring means disposed within the intermediate chamber of the three chambers and loaded between the diaphragms.

9 Claims, 7 Drawing Figures

FUEL INJECTION SYSTEM

BACKGROUND OF THE INVENTION

The present invention relates to generally a fuel distribution system for a spark ignition engine and more particularly a fuel distribution system therefor of the type for continuously injecting the fuel at a relatively low pressure into an intake air pipe of the individual cylinder.

When the fuel distribution system of the type described is used in conjunction with a multicylinder engine, the fuel in quantity in proportion to the intake air quantity must be injected into the intake air pipes of the individual cylinders of the engine, and the quantity of the fuel to be introduced into the individual cylinders must be uniformly controlled with higher accuracy. That is, the fuel must be evenly distributed in order to improve the engine operation and fuel economy and to reduce the toxious exhaust gas emissions. For this purpose, there have been proposed various fuel distribution systems, but in every system it is essential to use the fuel injection nozzles with the uniform characteristics. However, in view of the present levels of the manufacturing techniques it is impossible or extremely difficult to fabricate such fuel injection nozzles so that there arise the problems of interchangeability and readjustment of the whole system after the damaged fuel injection nozzles have been replaced. In one system, a fuel metering valve is provided for each fuel injection nozzle, but the flow rate of the fuel passing through the metering valve is very small in quantity so that the metering valve complex in construction must be used in order to control the fuel flow rate with higher accuracy, thus resulting in the increase in cost.

SUMMARY OF THE INVENTION

In view of the above, the present invention provides a fuel distribution system for an internal combustion engine of the type including a metering valve for metering or controlling the fuel to be introduced into the engine and a plurality of fuel injection nozzles for continuously injecting the fuel supplied from the fuel metering valve into the engine, said fuel distribution system characterized by the provision of a plurality of fuel distributors, each distributors comprising a housing, two diaphragms so arranged as to divide said housing into three chambers; that is, two chambers and one intermediate chamber between the outer chambers, restrictor means disposed in an intake port of each of said outer chambers, valve means disposed at a discharge port of each of said outer chambers, and spring means loaded within intermediate chamber between said two diaphragms, whereby the fuel supplied from said metering valve may be divided into two of the same flow rate and equal in number to the fuel injection valves.

One of the objects of the present invention is to provide a fuel supply system for an internal combustion engine which may evenly divide the fuel into a plurality of fuel flows equal in number to the fuel injection nozzles and hence the cylinders regardless of the non-uniform characteristics of the fuel injection nozzles used.

Another object of the present invention is to provide a fuel supply system for an internal combustion engine of the type described which is very simple in construction with the minimum number of structural members, especially movable members so that the wear of the system may be minimized.

BRIEF DESCRIPTION OF THE DRAWING

Same reference numerals are used to designate similar parts throughout the figures.

DESCRIPTION OF THE PREFERRED EMBODIMENTS

First Embodiment, FIGS. 1 through 5

Figure 1:
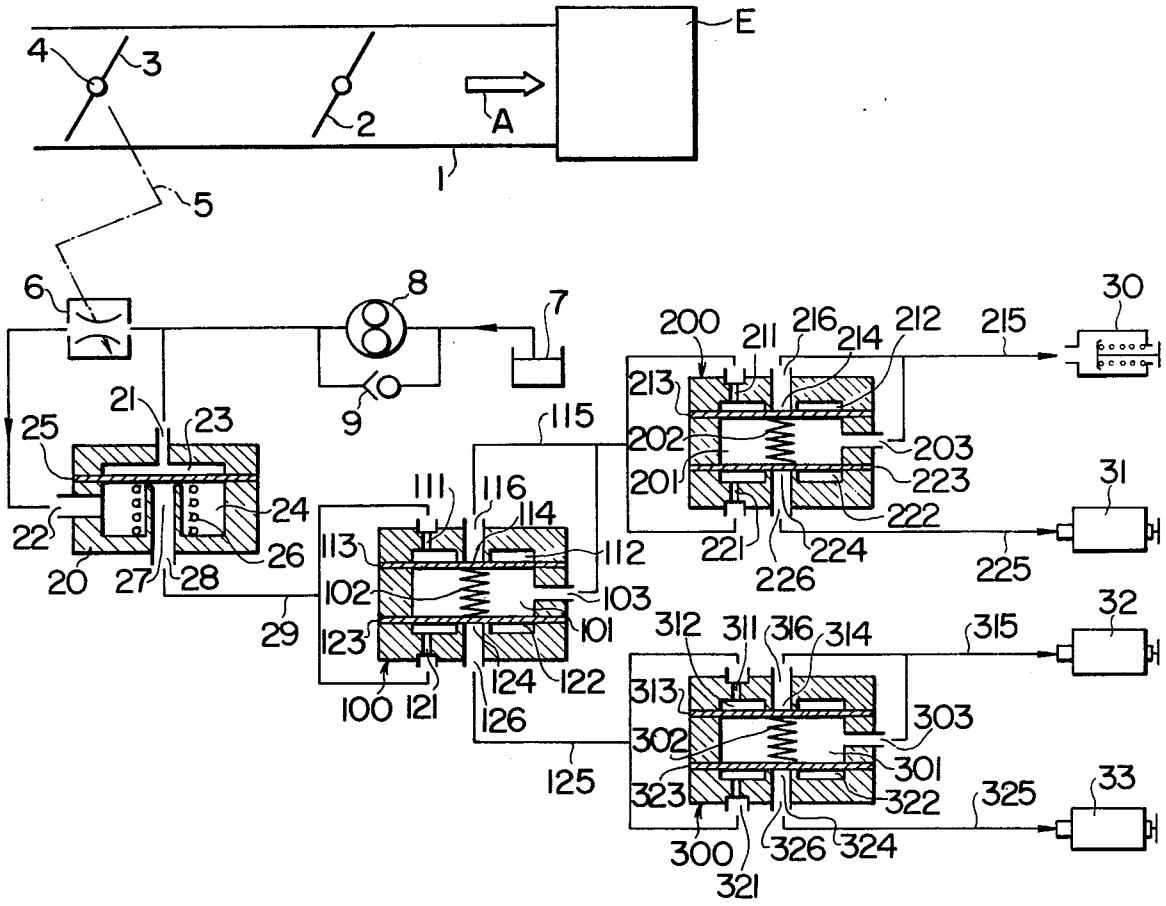
FIG. 1 is a diagrammatic view of a first embodiment of a fuel distribution system in accordance with the present invention.

In FIG. 1 there is shown diagrammatically a first embodiment of the present invention. In an air intake manifold 1 to an engine E are disposed a throttle valve 2 and an intake air regulating valve 3 carried by a shaft 4 at the upstream of the throttle valve 2 and operatively coupled through a linkage 5 to a fuel metering valve 6 so that the latter may control the flow rate of the fuel in response to the opening degree of the air regulating valve 3 and hence the intake air quantity. The fuel is supplied to the fuel metering valve 6 from a fuel tank 7 by a fuel pump 8 which is shunted by a pressure control valve 9 so that the fuel to be supplied to the metering valve 6 may be maintained at a desired pressure level and the excess fuel may be returned to the suction side of the fuel pump 8.

A differential pressure regulator 20 has two intake ports 21 and 22 and one discharge port 28, and is divided by a diaphragm 25 into an upper chamber 23 and a lower chamber 24. The upper chamber 23 is communicated through the first intake port 21 with the intake port of the fuel metering valve 6 while the lower chamber 24, with the discharge port of the metering valve 6 through the second intake port 22. The differential pressure regulator 20 further includes a valve 27 and a coiled spring 26 both of which are disposed within the lower chamber 24.

Since fuel distributors 100, 200 and 300 are exactly similar in construction, it will suffice to describe only the distributor 100. The fuel discharged from the differential pressure regulator 20 flows through a fuel line 29 and is branched to flow through a restrictor 111 into an upper outer chamber 112 defined within the distributor 100 by an upper diaphragm 113 and through a restrictor 121 into a lower outer chamber 122 defined by a lower diaphragm 123. The upper and lower chambers 112 and 122 are communicated through valves 114 and 124, respectively, with an upper and lower discharge ports 116 and 126, respectively, which in turn are communicated through fuel lines 115 and 125, respectively, with distributors 200 and 300. Within an intermediate pressure chamber 101 defined by the upper and lower diaphrams 113 and 123 is disposed a spring 102 interconnecting the upper and lower diaphragms 113 and 123, and the pressure chamber 101 is communicated through a port 103 with the fuel line 115 leading to the fuel distributor 200. The fuel lines 115 and 125 are branched and communicated with the restrictors 211 and 221 of the distributor 200 and with those 311 and 321 of the distributor 300, and the discharge ports 216, 226, 316, and 326 of the distributors 200 and 300 are communicated through the fuel lines 215, 225, 315 and 325 with fuel injection nozzles 30, 31, 32 and 33, respectively, which are so arranged as to inject the fuel into the intake air pipes to the respective cylinders (not shown).

Figure 2:
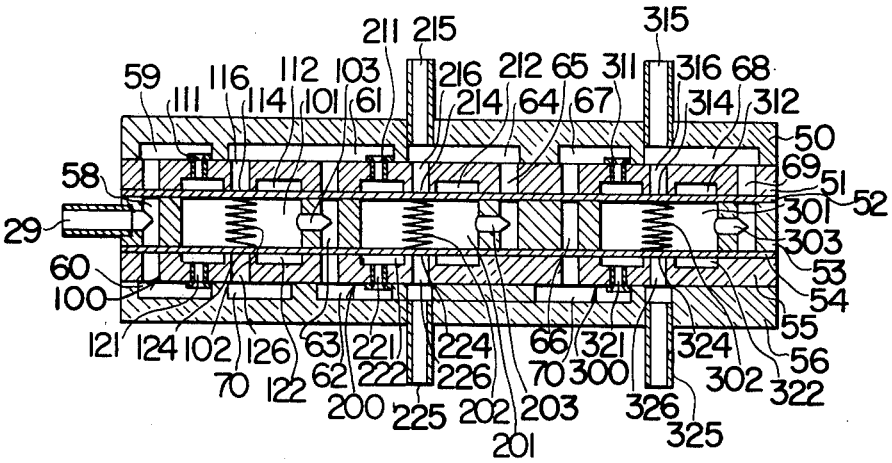
FIG. 2 is a sectional view of a fuel distributor assembly thereof consisting of three distributors as shown in FIG. 1.

Although the three fuel distributors 100, 200 and 300 are shown as the separate units in FIG. 1 for the sake of simplicity, they may be assembled as a unitary construction as shown in FIG. 2. The fuel distributor assembly shown in cross section in FIG. 2 comprises, in general, an upper and lower casing members 50 and 56 and intermediate casing members 51, 53 and 55, which serve to define the communication passages between the fuel distributors 100, 200 and 300 within the fuel distributor assembly as will be described in detail hereinafter, and an upper and lower diaphragm members 52 and 54 which are sandwiched between the intermediate casing member 53 on the one hand and the upper and lower intermediate casing members 51 and 55 on the other hand so as to function as the diaphragms 113, 123, 213, 223, 313 and 323 shown in FIG. 1. These structural members are assembled and securely held together with suitable joint means such as an adhesive agent or bolts and nuts. The restrictors 111, 121, 211, 221, 311 and 321 must be machined with higher accuracy so that they are formed independently of the upper and lower intermediate casing members 51 and 55.

The fuel line 29 extending from the discharge port 28 of the differential pressure regulator 20 is communicated with the restrictors 111 and 121 of the first distributor 100 through passages 58, 59 and 60. The first or upper discharge port 116 of the distributor 100 is communicated with the restrictors 211 and 221 of the next fuel distributor 200 through passages 61 and 62 defined by the structural members 50, 56, 51 and 55 and a passage 63 defined by the casing members 51, 53 and 55 and extended through the diaphragm members 52 and 54. The pressure chamber 101 of the first distributor 100 is communicated through the port 103 with the vertical passage 63. The upper discharge port 216 of the second distributor 200 is communicated not only with the fuel line 215 but also with the pressure chamber 201 of the second distributor 200 through passages 64 and 65 and a port 203. The lower discharge port 126 of the first distributor 100 is communicated with the restrictors 311 and 321 of the third distributor 300 through a horizontal passage 70, a vertical passage 66 and a horizontal passage 67. The upper discharge port 316 of the third distributor 300 is communicated not only with the pressure chamber 301 thereof through a horizontal and vertical passages 58 and 69 and a port 303 but also with the fuel line 315. The lower discharge port 326 of the third distributor 300 is communicated with the fuel line 325.

Next the mode of operation of the fuel distributor assembly with the above construction will be described in detail hereinafter with reference to FIGS. 1 and 2. The intake air introduced into the engine E is dependent upon the rotational speed of the engine and the opening degree of the throttle valve 2, and the intake air quantity is measured in terms of the angle of rotation of the shaft 4 of the air regulating valve 3 which is so operated as to maintain a constant pressure difference across the valve 3. The rotation of the shaft 4 is transmitted through the linkage 5 to the metering valve 6 so as to control the opening degree (throttling) thereof. Thus so long as the fuel pressure difference across the metering valve 6 is maintained at a constant level, the flow rate of the fuel passing through the metering valve 6 may be maintained in a predetermined ratio with respect to the intake air quantity. In the instant embodiment, the differential pressure regulator 20 is provided in order to maintain a predetermined pressure difference across the metering valve 6. That is, the first intake port 21 and hence the upper chamber 23 of the differential pressure regulator 20 is communicated with the intake port of the metering valve 6 while the second intake port 22 and hence the lower chamber 24 is communicated with the discharge port of the metering valve 6 so that the pressure difference between the upper and lower chambers 23 and 24 across the diaphragm 25 is dependent upon the force of the coiled spring 26 within the lower chamber 24. This pressure difference is given by $$Pv_1 - Pv_2 = Fv/Av$$

where $Pv_1$ and $Pv_2$ = fuel pressures in the upper and lower chambers 23 and 24, respectively;

$Av$ = effective area of the diaphragm 25; and $Fv$ = load or force of the spring 26, the opening area of the valve 27 being assumed as sufficiently small. Therefore, the pressure difference across the metering valve 6 may be always maintained at a constant level so that the fuel in quantity in proportion to the intake air quantity may be introduced into the first distributor 100. Assuming that the opening areas of the valves 114 and 124 be sufficiently smaller than the effective area A of the diaphragms 113 and 123, the following relations are held;

$$F + Pb\mathrm{A} = P_1\mathrm{A}$$
$$F + Pb\mathrm{A} = P_2\mathrm{A}$$

where $F$ = force of the spring 102;

$Pb$ = pressure in the chamber 101;

$P_1$, $P_2$ = pressures in the upper and lower chambers 112 and 122; and $A$ = effective area of the diaphragms 113 and 123.

Therefore the opening degrees of the valves 114 and 124 are so controlled that the pressures in the upper and lower chambers 112 and 122 may be made equal to each other, and the fuel flows out of the discharge ports 116 and 126. It is of course true that the pressures in the upper and lower chambers 112 and 122 are higher than those at the discharge ports 116 and 126 so that the absolute values of the pressures in the upper and lower chambers 112 and 122 are varied over a wide range depending upon the flow rate of the fuel with the result of the greater displacement of the diaphragms 113 and 123. In order to limit the displacement of the diaphragms 113 and 123 so as to attain the effective operation of the valves 114 and 124, the upper discharge port 116 is communicated with the pressure chamber 101 so that the pressure P01 at the discharge port 116 may be transmitted to the pressure chamber 101. Therefore, $Pb$ = P01, and hence $$P_1 = Po_1 + F/\mathrm{A}$$

$$P_2 = Po_1 + F/A$$

The pressures $P_1$ and $P_2$ in the upper and lower chambers 112 and 122 are equal to each other, and the pressures at the streams of the restrictors 111 and 121 are also equal to each other because the restrictors 111 and 121 are communicated with the same fuel line 29. Therefore the pressure differences across the restrictors 111 and 121 are always maintained equal to each other, so that the quantity of the fuel flowing through the restrictors 111 and 112 into the upper and lower chambers 112 and 122 is in proportion to the opening areas of the restrictors 111 and 121. According to the present invention, the opening areas of the restrictors 111 and 121 are made equal so that the distributor 100 divides the fuel flowing through the fuel pipe 29 into two flows in the same ratio (that is, 1 : 1) which are supplied to the next distributors 200 and 300. In like manner, each of the distributors 200 and 300 divides the incoming fuel flow into two flows in the same ratio, which are supplied through the fuel lines 215, 225, 315 and 325 to the fuel injection nozzles 30, 31, 32 and 33. Thus, the fuel discharged from the metering valve 6 can be precisely divided into ¼ by the distributors 100, 200 and 300.

As described hereinbefore with reference to FIG. 2, the distributors 100, 200 and 300 may be assembled as a unitary construction so that the fuel distribution system in accordance with the present invention may be made compact in size.

So far the fuel distribution system with three distributors 100, 200 and 300 in accord with the present invention has been described in conjunction with the four-cylinder engine, but it is to be understood that the fuel distribution system of the present invention may be applied also to the eight-cylinder engine when the number of distributors is increased. Furthermore, it is possible to divide the fuel into three, six or twelve when the ratio between the opening areas of the restrictors of the distributor is selected 1 : 2 so that the fuel distribution system in accordance with the present invention may be also applied to the six- or twelve-cylinder engine. The fuel metering valve 6 may be provided for each cylinder group consisting of a suitable number of cylinders in such a way that the fuel metered or controlled by the metering valve may be equally divided by the distributors for the cylinders in each group.

As described hereinbefore, the fuel may be divided by a pair of restrictors in a desired ratio. With the restrictors with a fixed opening area, it is known that the pressure difference across the restrictor increases in proportion to the square of the flow rate of the fluid passing therethrough. In the distributors of the fuel distribution system in accordance with the present invention, the flow rate varies over a relatively wide range so that the pressure difference across the restrictor is increased considerably. On the other hand, when the flow rate is varied over a relatively wide range within the fuel distribution system with a relatively low rated pressure, the pressure difference across the restrictor becomes extremely small especially when the flow rate is greater so that the division of fuel with a desired high accuracy becomes impossible because of the external influence such as vibration exerted to the diaphragms. This problem is however solved by the variation of the present invention to be described hereinafter with reference to FIGS. 3 through 5.

VARIATION OF DISTRIBUTORS, FIGS. 3, 4 AND 5

Figure 3:
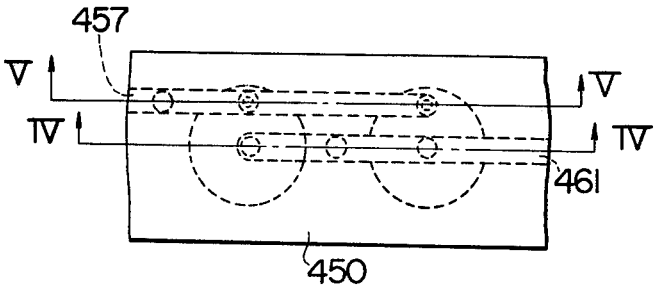
FIG. 3 is a top view of a variation of a fuel distributor assembly consisting of two distributors as shown in FIG. 1 hydraulically coupled in parallel with each other.
Figure 4:
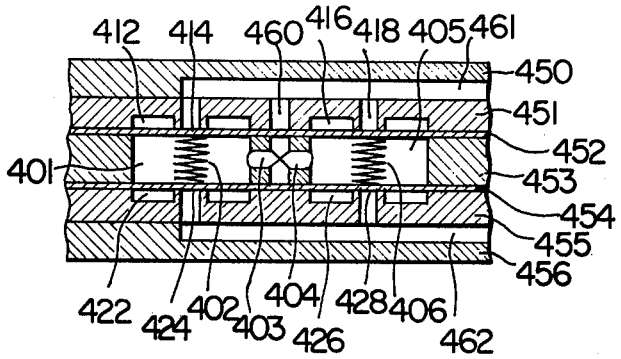
FIGS. 4 and 5 are sectional views thereof taken along the lines IV — IV and V — V, respectively, of FIG. 3.
Figure 5:
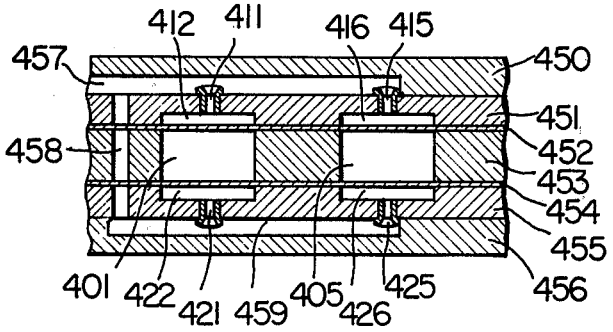

The distribution assembly shown in FIGS. 3, 4 and 5 comprises two distributors 100 which are hydraulically connected in parallel to each other, and has one intake passage 457 and two discharge passages 461 and 462 defined by casing members 450, 456, 451, 453 and 455, which also define, together with diaphragm members 452 and 454, the upper and lower chambers and the pressure chambers as with the case of the distributor assembly of the type shown in FIG. 2. The intake passage 457 is communicated through restrictors 411 and 415 with upper chambers 412 and 416 and with lower chambers 422 and 426 through a vertical passage 458, a horizontal passage 459 and restrictors 421 and 425. The upper chambers 412 and 416 are communicated with the upper discharge passage 461 through valves 414 and 418 formed in the case member 451 as best shown in FIG. 4 and with pressure chambers 401 and 405 through a vertical passage 460 and ports 403 and 404, respectively. As with the case of the distributor assembly shown in FIG. 2, the diaphragm members 452 and 454 are interconnected with each other by springs 402 and 406 which are disposed within the pressure chambers 401 and 405, respectively, defined by the upper and lower diaphragm members 452 and 454. The lower chambers 422 and 426 are communicated with the lower discharge passage 462 through valves 424 and 428, respectively, formed through the case member 455. The force of the spring 402 is selected stronger than that of the spring 406, and the opening areas of the restrictors 415 and 425 are made greater than those of the restrictors 411 and 421.

As with the case of the distributor assembly shown in FIG. 2, the pressures in the upper and lower chambers 412 and 422 are equal to each other and are given by $$Pj_L = Po + F_L/A$$

where $Po$ = pressure in the pressure chamber 401;

$F_L$ = force of the spring; and $A$ = effective area of the diaphragm members 452 and 454.

Since the pressure in the pressure chamber 405 is equal to that $Po$ in the pressure chamber 401, the pressure $Pj_R$ in the pressure chambers 416 or 426 of the right distributor is given by $$Pj_R = Po + F_R/A$$

where $F_R$ = force of the spring in the right distributor. Since the force $F_R$ of the spring 406 is greater than the force $F_L$ of the spring 402, $F_R/A$ is greater than $F_L/A$ so that $Pj_R$ is greater than $Pj_L$. When the pressure in the intake passage 457 is Pi and the flow rate of fuel is relatively small, the pressure difference ($Pi - Pj_L$) across the restrictor 411 or 421 is relatively small. The valves 414 and 424 are opened under the pressure of $Pj_L$ so that the fuel in the upper and lower chambers 412 and 422 flows into the discharge passages 461 and 462. Since the pressure Pi is not so high, the pressure in the chambers 416 and 412 is not so high as to open the valves 418 and 428. As the flow rate of the fuel is increased, the pressure difference ($Pi - Pj_L$) is also increased. When the pressure $Pi = Pj_R$ becomes equal to the pressure ($Po + F_R/A$), the valves 418 and 428 are opened so that the fuel flows through the restrictors 415 and 425 into the chambers 416 and 426 and flows therefrom through the valves 418 and 428 into the discharge chambers 461 and 462. As the flow rate of fuel is further increased, the fuel is divided by the restrictors 411, 421, 415 and 425.

In summary, when the flow rate is relatively low, the fuel divided by the right distributor with the restrictors 411 and 421 having a relatively small opening area and with the spring 402 of a relatively small force $F_L$, but when the flow rate is increased beyond a predetermined level, the right distributor with the restrictors 415 and 425 having a relatively large opening area and with the spring 406 of a relatively stronger force $F_R$ also divides the fuel flow in cooperation with the left distributor. Thus, even when the flow rate of fuel varies over a wide range, the excessive increase in pressure difference across the restrictor may be prevented so that the precise division of the fuel flow may be effected.

SECOND EMBODIMENT, FIG. 6

In the fuel distribution system shown in FIG. 1, even when the fuel pressures in the upstream of the restrictors 111 and 121 are equal to each other and the opening areas of the valves 114 and 124 are also equal to each other, the flow resistances encountered in the downstream of the discharge ports 116 and 126 are different because of the difference in characteristics of the fuel injection nozzles so that the flow rates of fuel passing through the restrictors 111 and 121 are different. That is, the pressure P1 in the upper chamber 112 is different from the pressure $P_2$, but in practice the opening degrees of the valves are so controlled that $P_1 = P_2 = Pb + F/A$ as described hereinbefore. When the pressure $Po_1$ at the upper discharge port 116 is lower than the pressure $Po_2$ at the lower discharge port 126 and the pressure $Po_1$ is transmitted to the pressure chamber 101 as with the case of the first embodiment shown in FIG. 1, the displacement of the diaphragm 123 due to the pressure $\Delta P = P_2 - P_1$ is $\Delta l$ so that the upper diaphragm 113 is exerted with the pressure $\Delta P' = \Delta l \times k$ where $k$ = spring constant of the spring 102. As a result, the pressure $P_1$ is increased to $P_1 + \Delta P'$, but due to the resistance to the deformation of the diaphragm, $\Delta P'$ is smaller than $\Delta p$ so that the pressures $P_1$ and $P_2$ are not equal to each other. On the other hand, when the higher pressure $Po_2$ is transmitted to the pressure chamber 101.

$$P_2 = F/A + Po_2$$

so that the opening area of the valve 114 is reduced until the pressure $p_1$ becomes equal to the pressure $P_2$. Thus, the fuel flow is divided in a ratio in proportion to the ratio between the opening areas of the restrictors 111 and 121.

Figure 6:
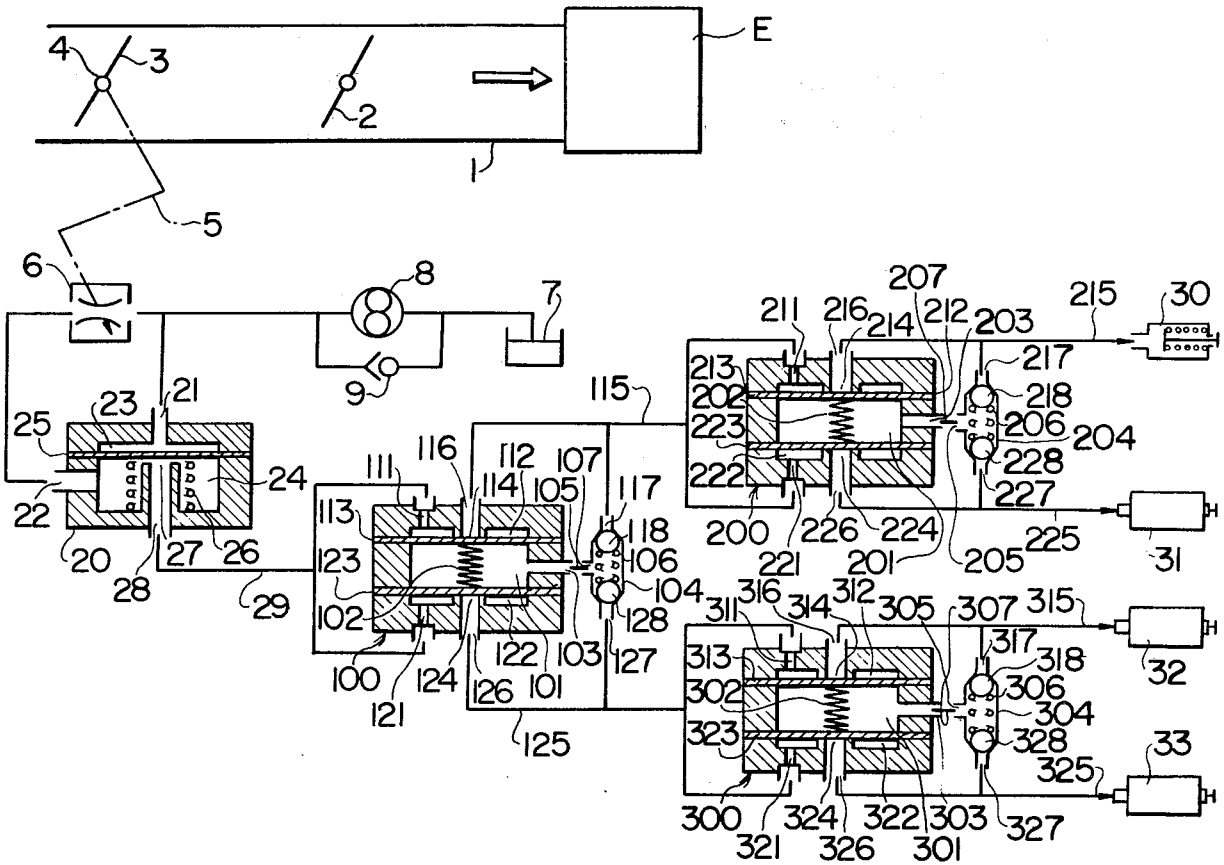
FIG. 6 is a diagrammatic view of a second embodiment of the present invention.
Figure 7:
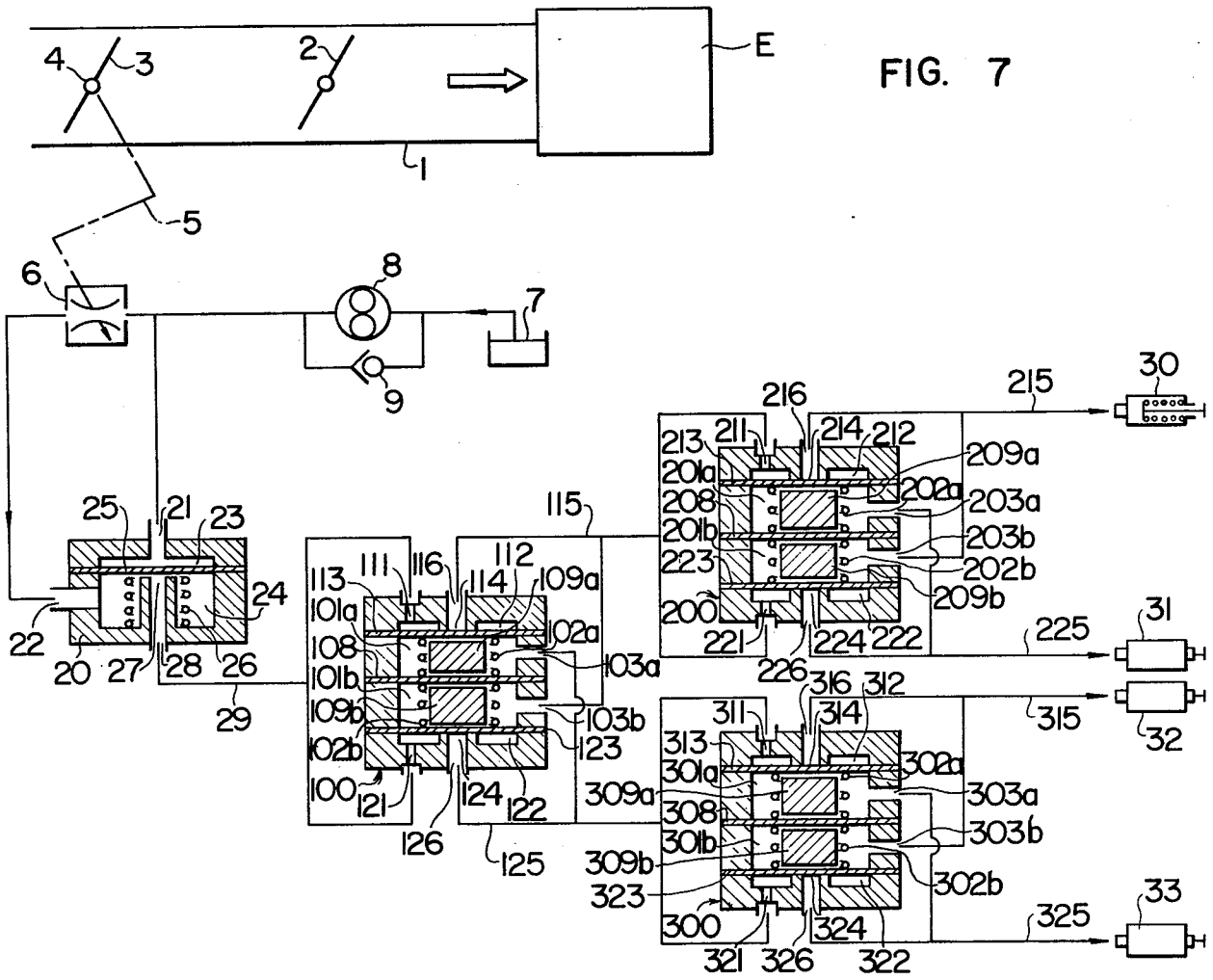
FIG. 7 is a diagrammatic view of a third embodiment of the present invention.

Therefore, in the second embodiment shown in FIG. 6, a check valve 104 is provided so that the higher pressure $Po_1$ or $Po_2$ may be transmitted to the pressure chamber 101. That is, when the higher pressure $Po_2$ is transmitted to the pressure chamber 101, the lower pressure $P_1$ in the upper chamber 112 may be increased to be equal to the higher pressure $P_2$ in the lower chamber 122. When the pressure $Po_2$ is higher than the pressure $Po_1$, $$P_1 = Po_2 + F/A$$
$$P_2 = Po_2 + F/A$$

That is, the pressure $P_1$ or $P_2$ in the chamber 112 or 122 is always made F/A higher than the pressure $Po_2$ which is a reference pressure. On the other hand, when the pressure $Po_1$ is higher than the pressure $Po_2$, the former is transmitted to the pressure chamber 101 so that the pressures in the upper and lower chambers 112 and 122 may become equal to each other based on the reference pressure $Po_1$. Thus, according to the second embodiment the pressures in the upper and lower chambers 112 and 122 are so controlled as to be equal to each other and the pressures at the upstream of the orifices 111 and 121 are equal as the latter are communicated with the common fuel line 29 so that the pressure differences across the restrictors 111 and 121 may be maintained always equal to each other. Therefore, the fuel flows into the upper and lower chambers 112 and 122 at the flow rates in proportion to the ratio between the opening areas of the restrictors 111 and 112. In the second embodiment, the ratio between the opening areas is selected 1 : 1 so that the fuel may be divided by the distributor 100 into two flows of the same flow rate. In like manner, the fuel is divided by the distributor 200 or 300 into two flows of the same flow rate.

THIRD EMBODIMENT, FIG. 7

The third embodiment of the present invention is provided in order to attain the fuel flow division with higher accuracy than the first embodiment shown in FIG. 1. For this purpose, the pressure chamber 101 defined by the upper and lower diaphragms 113 and 123 is further divided into two chambers **101*a* and 101*b* by an additional diaphragm 108, and cylindrical spacer members 109*a* and 109*b* are disposed within the upper and lower pressure chambers 101*a* and 101*b*, respectively. Within the upper and lower pressure chambers 101*a* and 101*b* are also disposed springs 102*a* and 102*b*, respectively, between the upper diaphragm 113 and the intermediate diaphragm 108 and between the lower diaphragm 123 and the intermediate diaphragm 108, respectively. The upper pressure chamber 101*a* is communicated with the discharge port 126 of the chamber 122 while the lower pressure chamber 101*b* is communicated with the discharge port 116 of the upper chamber 112.**

Next the mode of operation of the third embodiment with the above construction will be described in detail hereinafter. When the opening areas of the valves 114 and 124 are selected sufficiently smaller than the effective area of the diaphragms 113, 123 and 108, the following relations are held:

$$F_1 + F_3 + Pb_1(A - B) = P_2A,$$
$$F_2 + Pb_2A = F_3 + Pb_1(A - B) + F_1, \text{ and}$$
$$P_2A = F_2 + Pb_2A$$

where $P_1$, $P_2$ = pressures in the upper and lower chambers 112 and 122, respectively;

$Pb_1$, $Pb_2$ = pressures in the upper and lower pressure chambers **101*a* and 101*b*,** respectively;

$F_1$, $F_2$ = forces of the springs **102*a* and 102*b*,** respectively;

$A$ = effective pressure receiving area of the diaphragms 113, 123 and 108;

$B$ = sectional area of the spacers **109*a* and 109*b* in parallel with the diaphragms 113, 123 and 108; and $F_3$ = force transmitted through the spacer 109*a* or 109*b*.**

From the above three relations, $P_1 = P_2$

So far the pressure ($F_2 + Pb_2A$) is higher than the pressure ($F_1 + Pb_1A$), but the same relations may be held even when the pressure ($F_1 + Pb_1A$) is higher than the pressure ($F_2 + Pb_2A$). When the above two pressures are equal, the following relations are held:

$$F_1 + Pb_2A = P_1A$$
$$F_2 + Pb_2A = F_1 + Pb_1A$$
$$P_2A = F_2 + Pb_2A$$

Therefore the opening degrees of the valves 114 and 124 are so controlled that the pressures in the chambers 112 and 122 may become equal to each other and the quantities of the fuel discharged through the discharge ports 116 and 126 are equal to each other.

In the third embodiment, even when the flow resistances in the downstreams of the restrictors 114 and 124 are different, the pressures in the chambers 112 and 122 are equal; that is, $P_1 = P_2$ and the pressures in the upstreams of the restrictors 111 and 121 are also equal because the latter are communicated with the common fuel line 29 so that the pressure differences across the restrictors 111 and 121 may be maintained always equal to each other. Thus, the quantities or flow rates of fuel flowing into the chambers 111 and 121 are in proportion to the ratio between the opening areas of the restrictors 111 and 121. In the third embodiment, this ratio is selected 1 : 1 so that the fuel supplied through the fuel line 29 is divided by the distributor 100 into two flows of the same flow rate. In like manner, the fuel flow is divided by the distributor 200 or 300 into two flows of the exactly same flow rate.

The distributors 100, 200 or 300 in the second and third embodiments may be arranged in parallel with each other as with the case of the variation of the first embodiment described with reference to FIGS. 3, 4 and 5.

What is claimed is:

1. A fuel injection system for use in combination with an internal combustion engine having a plurality of fuel injection nozzles, comprising means for metering the total quantity of fuel flow to be introduced into the engine and fuel distribution means for distributing the fuel from said fuel metering means equally to said plurality of fuel injection nozzles, said distribution means including at least one fuel dividing means for dividing one fuel flow into two fuel flows in a predetermined ratio, said fuel dividing means comprising a housing defining therein with at least one enclosed space, first and second diaphragms arranged to divide each said space into two outer chambers and an intermediate chamber between said outer chambers, a first inlet means into one of said outer chambers for receiving said one fuel flow, a second inlet means into the other of said outer chambers for receiving said one fuel flow, restrictor means communicated with each of said first and second inlet means for restricting fuel flow into each of said outer chambers, the opening areas of said respective restrictor means being in said predetermined ratio, discharge means having a valve port located in opposed relation with said diaphragm and a discharge passage for discharging fuel from each of said outer chambers through said valve port to said discharge passage, spring means disposed within said intermediate chamber and extending between said diaphragms, and means for introducing a part of the fuel in at least one of said discharge passages into said intermediate chamber, whereby said two fuel flows in the predetermined ratio are obtained through said respective discharge passages.

2. A fuel injection system as set forth in claim 1, wherein said predetermined ratio is 1 to 1.

3. A fuel injection system as set forth in claim 1, wherein said predetermined ratio is 1 to 2.

4. A fuel injection system as set forth in claim 1, wherein a plurality of said dividing means are arranged such that at least one of said discharge passages of one of said dividing means is connected to said inlet means of another one of said dividing means.

5. A fuel injection system as set forth in claim 4, wherein said plurality of dividing means have a fuel flow dividing ratio of 1 to 1 and are arranged such that said discharge passages of one of said dividing means are connected to said inlet means of the other two of said dividing means, respectively.

6. A fuel injection system as set forth in claim 4, wherein at least one of said dividing means has a fuel dividing ratio of 1 to 2 and one of said discharge passages of said one of dividing means having the larger discharge flow is connected to said inlet means of one of said dividing means having a fuel dividing ratio of 1 to 1.

7. A fuel injection system as set forth in claim 1, wherein said housing of said fuel dividing means defines first and second enclosed spaces, said discharge means for said first space being connected in common with said discharge means of said second space, the force of said spring means for said first space is greater than that for said second space, said ratios of the opening areas of said restrictor means for said respective first and second spaces are same but the opening area of each of said restrictor means for said first space is larger than that of the associated one of said restrictor means for said second space.

8. A fuel injection system as set forth in claim 1, further comprising means for communicating the one of said two discharge passages which is at a higher pressure with said intermediate chamber.

9. A fuel distribution system as set forth in claim 1, further comprising a third diaphragm so arranged as to divide said intermediate chamber into two sub-chambers, spring means disposed within each of said sub-chambers and loaded between said first and second diaphragms and said third diaphragm, spacer means disposed within each of said sub-chambers and spaced apart by a predetermined distance from said first or second diaphragm and said third diaphragm, and said discharge passage of one of said two outer chambers being communicated with said sub-chamber located adjacent the other outer chamber while said discharge passage of the other outer chamber being communicated with the outer sub-chamber located adjacent to said one outer chamber.

* * * * *